US007658317B2

(12) United States Patent
Wilkins

(10) Patent No.: US 7,658,317 B2
(45) Date of Patent: Feb. 9, 2010

(54) DISPENSING PACKAGE

(75) Inventor: Zoe Claire Wilkins, Keynsham (GB)

(73) Assignee: Graphic Packaging International, Inc., Marietta, GA (US)

( * ) Notice: Subject to any disclaimer, the term of this patent is extended or adjusted under 35 U.S.C. 154(b) by 181 days.

(21) Appl. No.: 11/431,091

(22) Filed: May 9, 2006

(65) Prior Publication Data

US 2006/0255044 A1 Nov. 16, 2006

Related U.S. Application Data

(63) Continuation of application No. PCT/GB2004/004526, filed on Oct. 27, 2004.

(51) Int. Cl.
*B65D 17/28* (2006.01)

(52) U.S. Cl. ..... 229/122.1; 206/427; 229/242

(58) Field of Classification Search ..... 229/122.1, 229/240, 242; 206/427; 221/302, 305
See application file for complete search history.

(56) References Cited

U.S. PATENT DOCUMENTS

| | | | | |
|---|---|---|---|---|
| 1,896,326 | A | 2/1933 | Northway-Ley | |
| 1,898,646 | A | 2/1933 | Taylor | |
| 1,915,341 | A | 6/1933 | Walker et al. | |
| 1,987,771 | A * | 1/1935 | Bueschel | 229/122.1 |
| 2,875,942 | A | 3/1959 | Wilson | |
| 3,066,843 | A * | 12/1962 | Johnson | 229/122.1 |
| 3,300,115 | A | 1/1967 | Schauer | |
| 3,309,206 | A * | 3/1967 | Daniels | 229/122.1 |
| 3,701,466 | A * | 10/1972 | Woodrow et al. | 221/302 |
| 3,822,785 | A | 7/1974 | Getz et al. | |
| 3,937,326 | A | 2/1976 | Schick | |
| 4,120,443 | A | 10/1978 | Gardner et al. | |
| 4,421,229 | A | 12/1983 | Pan et al. | |
| 4,577,799 | A | 3/1986 | Oliff | |
| 5,234,102 | A | 8/1993 | Schuster et al. | |
| 5,246,113 | A | 9/1993 | Schuster | |
| 5,368,194 | A * | 11/1994 | Oliff et al. | 221/305 |
| 5,415,344 | A | 5/1995 | Harrelson | |
| 5,427,242 | A | 6/1995 | Oliff et al. | |
| 5,437,143 | A | 8/1995 | Culpepper et al. | |
| 5,518,111 | A | 5/1996 | Stout | |
| 5,620,094 | A | 4/1997 | Naumann | |
| 5,669,500 | A | 9/1997 | Sutherland | |
| 5,682,984 | A | 11/1997 | Howell et al. | |
| 5,772,030 | A | 6/1998 | Baxter | |
| 5,826,783 | A | 10/1998 | Stout | |
| 5,826,870 | A | 10/1998 | Vulgamore et al. | |

(Continued)

FOREIGN PATENT DOCUMENTS

| | | |
|---|---|---|
| CH | 263456 | 8/1949 |

(Continued)

*Primary Examiner*—Gary E Elkins
(74) *Attorney, Agent, or Firm*—Womble Carlyle Sandridge & Rice, PLLC

(57) ABSTRACT

There is provided a paperboard carton for receiving articles in two or more layers separated by a divider pad which is secured relative to an end panel arrangement at one end of the carton. The carton has a top panel, a base panel and a pair of opposite sides. One of the side panels has a removable portion adjacent one end which when removed defines a roll out aperture for article removal when the carton is lying on said one end panel arrangement.

46 Claims, 6 Drawing Sheets

U.S. PATENT DOCUMENTS

| | | | | |
|---|---|---|---|---|
| 5,868,252 | A | 2/1999 | Oliff | |
| 5,878,947 | A | 3/1999 | Hoy et al. | |
| 5,938,109 | A | 8/1999 | Sainz et al. | |
| 5,957,288 | A | 9/1999 | Campbell | |
| 5,967,406 | A | 10/1999 | Moorman | |
| 5,996,883 | A | 12/1999 | Bates | |
| 6,012,630 | A | 1/2000 | Block | |
| 6,112,977 | A | 9/2000 | Sutherland et al. | |
| 6,176,419 | B1 | 1/2001 | Holley, Jr. | |
| 6,991,107 | B2 | 1/2006 | Harrelson | |
| 7,093,713 | B2 | 8/2006 | Sutherland | |
| 2005/0115843 | A1 | 6/2005 | Harrelson | |
| 2005/0167290 | A1 | 8/2005 | Sutherland | |
| 2005/0167291 | A1 | 8/2005 | Sutherland | |
| 2005/0167292 | A1 | 8/2005 | Sutherland | |
| 2006/0249413 | A1 * | 11/2006 | Auclair et al. | 206/427 |

FOREIGN PATENT DOCUMENTS

| | | | |
|---|---|---|---|
| DE | 88 14 144.6 | | 1/1989 |
| DE | G 91 11 941.3 | | 2/1992 |
| FR | 1427897 | | 4/1966 |
| FR | 1489087 | | 7/1967 |
| FR | 1497652 | | 10/1967 |
| FR | 2223985 | | 10/1974 |
| GB | 434145 | | 8/1935 |
| GB | 2 198 709 | A | 6/1988 |
| GB | 2 323 352 | | 9/1998 |
| JP | 7-125745 | | 5/1995 |
| JP | 9-502147 | | 3/1997 |
| JP | 9-142449 | | 6/1997 |
| JP | 11-130049 | | 5/1999 |
| JP | 2000-85754 | | 3/2000 |
| WO | WO 95/06425 | | 3/1995 |
| WO | WO 96/29261 | | 9/1996 |
| WO | WO 02/14166 | A1 | 2/2002 |
| WO | WO 02/30764 | A4 | 4/2002 |
| WO | WO 2004/014755 | A1 | 2/2004 |

* cited by examiner

DISPENSING PACKAGE

CROSS-REFERENCE TO RELATED APPLICATIONS

This application is a continuation of PCT application No. PCT/GB2004/004526, filed on Oct. 27, 2004, and designating the United States of America, and which application claims priority to British application No. GB0326435.5, filed Nov. 13, 2003.

INCORPORATION BY REFERENCE

The specifications and drawings of PCT application No. PCT/GB2004/004526, filed on Oct. 27, 2004, and British patent application No. GB0326435.5, filed on Nov. 13, 2003, are incorporated herein in their entirety, by this reference.

FIELD OF THE INVENTION

The present invention relates to dispensing packages and more particularly, but not exclusively, those for canned products such as food and drink.

BACKGROUND

Commonly, canned food/drink products are supplied in a shallow tray made of paperboard or corrugated board, with a shrink wrapping of plastic film. A number of these shrink wrapped trays are often stacked one above the other on a supermarket shelf. The trays are usually stacked on their widest surface which can be considered as lacking space efficiency, particularly if only one tray is on the shelf. Additionally the shrink wrap is not good for assisting in product differentiation.

In co-pending international patent application PCT/GB2003/003351, there is provided a paperboard carton for articles arranged in at least two layers, the carton having a top panel, a base panel, a pair of oppositely disposed side panels and a pair of oppositely disposed end panel arrangements, a divider pad being provided between the adjacent layers of articles and being secured relative to the end panel arrangement at one end, one of the side panels having a removable portion adjacent said one end so as to define a roll-out aperture for article removal when the carton is lying on said one end panel arrangement. In some embodiments one or more cuts extend partway to the adjacent end from the removable portion. Conveniently two of said cuts extend along the folds between said one side panel and the top and base panels respectively and also a transverse cut is provided at the end of the or each cut remote from the removable portion.

SUMMARY OF THE INVENTION

According to the present invention there is provided a paperboard carton for articles arranged in at least two layers, the carton having a top panel, a base panel, a pair of oppositely disposed side panels, a pair of oppositely disposed end panel arrangements and a divider pad provided between the adjacent layers of articles and being secured relative to the end panel arrangement at one end, one of the side panels having a removable portion adjacent said one end so as to define by means of primary lines of weakness a roll-out aperture for article removal when the carton is standing on said one end panel arrangement, which removable portion has extensions which extend into the top and base panels, wherein a secondary line of weakness extends from each of the extensions to the adjacent end edge of the top and base panels respectively.

Preferably each end panel arrangement incorporates a pair of oppositely disposed main end flaps hingedly connected to the top and base panels respectively. In a preferred arrangement the start of each secondary line of weakness adjacent the extension is closer to the side edge than the end of the line of weakness at the end edge. With some embodiments each secondary line of weakness if serpentine in shape.

A further preferred feature is that each secondary line of weakness continues into the adjacent main end flap. Conveniently the continuation of each secondary line of weakness is angled back towards the side edge and terminates at a transverse T-shaped cut and also the upright of the T-shaped cut is generally parallel to the side edge and the cross-bar of the T-shaped cut is generally parallel to the end edge.

Ideally each secondary line of weakness comprises a cut having a number of breakable retaining bridges.

Preferably the divider pad is secured relative to the other end panel arrangement. In preferred embodiments the divider pad has a fold down gluing panel at the or each secured end. With a preferred arrangement the top end flap is folded down last and is adhesively secured to all its associated end flaps of its associated end panel arrangement and to its associated fold down gluing panel.

Ideally a single straight glue line effects said adhesive attachment of the top end flap to the other end flaps and gluing panel. In one such embodiment the base end flap has a central projecting area such that the straight glue line is provided in turn on one of the side end flaps, the gluing panel, the central area of the base end flaps, the gluing panel and the other side end flap.

Normally, the top panel, base panel, two side and two end panel arrangement panels are substantially rectangular but other arrangements could be envisaged.

BRIEF DESCRIPTION OF THE DRAWINGS

An embodiment of the present invention will now be described in more detail. The description makes reference to the accompanying drawings in which.

DETAILED DESCRIPTION OF THE EMBODIMENT

Figure 1:
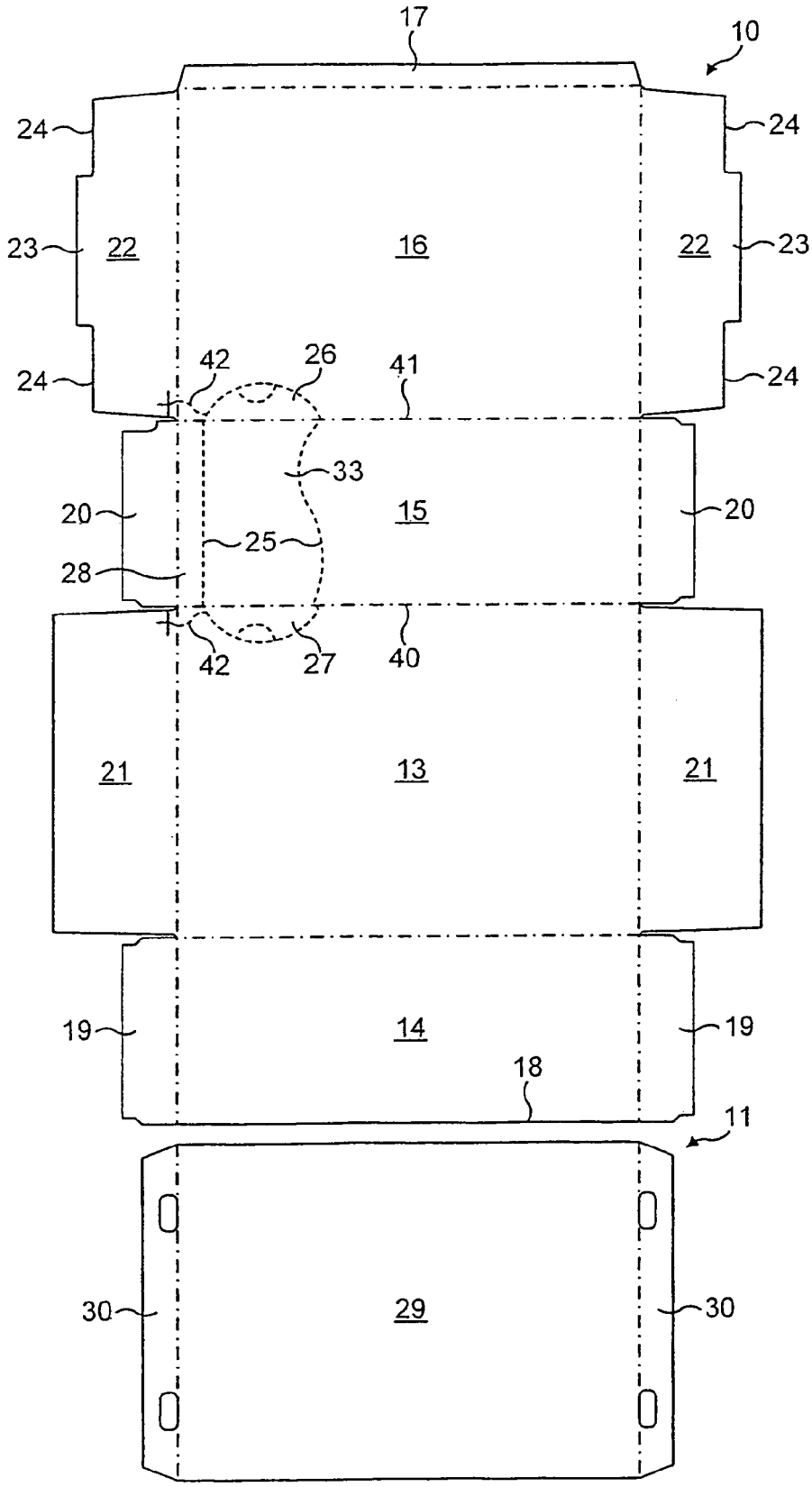
FIG. 1 shows two paperboard blanks for producing a carton according to the present invention.
Figure 6:
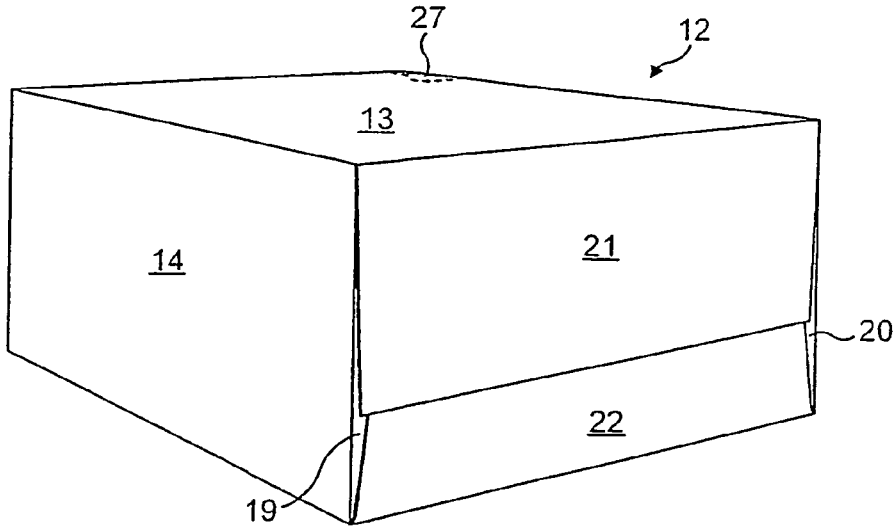
Figure 7:
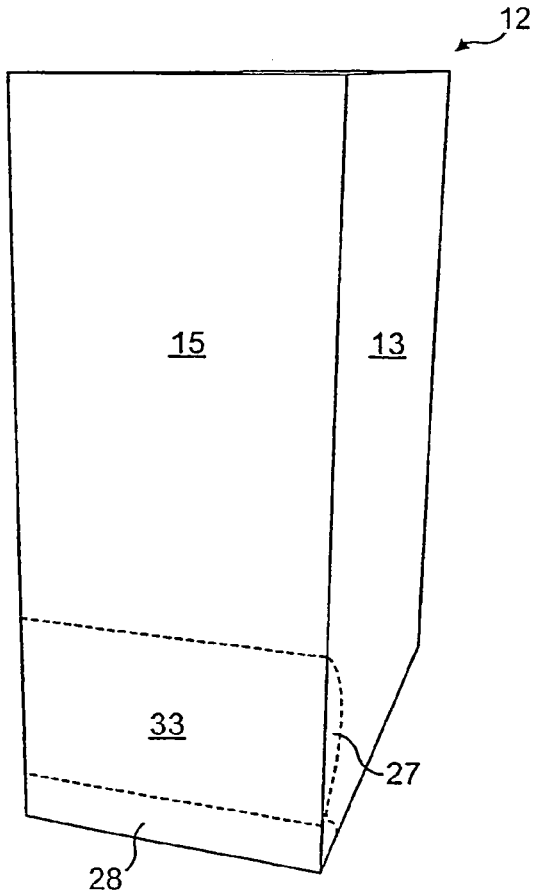
FIG. 7 is a side perspective view of the assembled carton standing on one end.

In FIG. 1 there is shown a pair of paperboard blanks 10, 11 for producing a carton 12 which is shown in FIG. 7 in an assembled condition standing on one end. The various stages of assembly are illustrated in perspective in FIGS. 2 to 6.

The main blank 10 is used to form the basic carton shape and provides a top panel 13 hingedly connected to oppositely disposed side panels 14, 15. Side panel 15 is in turn hingedly connected to a base panel 16 which is hingedly connected to an adhesive flap 17. The main blank 10 is formed into a general sleeve shape by adhering the adhesive flap 17 to the area adjacent the free edge 18 of the side panel 14.

Side end flaps 19, 20 are hingedly connected to side panels 14, 15 respectively at each end of the blank 10. A top end flap 21 is hingedly connected to the top panel 13 at each end and similarly a base end flap 22 is hingedly connected to the base panel 16 at each end of the blank 10. Each base end flap 22 has a central area 23 which projects beyond the adjacent free edges 24 of the base end flap 22 and the reason for this will be clarified later.

Side panel 15 also incorporates a removable portion 33 defined by primary lines of weakening 25 such as perforations. The removable portion 33 extends partially at 26 into the base panel 16 and at 27 into the top panel 13. A small portion 28 of the side panel 15 is intended to remain after the removable portion 33 has been removed thereby to act as a stop wall. Other forms and shapes of roll-out feature could also be substituted for the illustrated one.

The second blank 11, a divider pad, comprises a rectangular main panel 29 which corresponds in size and shape to the top and base panels 13, 16 of the main blank 10. At each end of the main panel 29 a fold-down glue panel 30 is hingedly connected.

Figure 2:
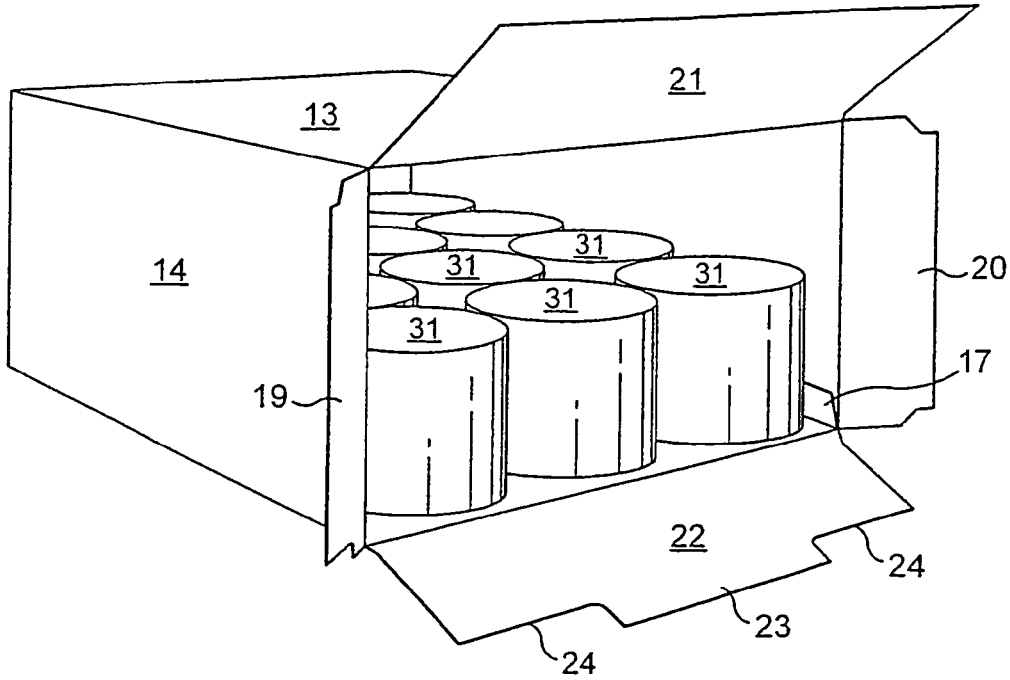
FIGS. 2 to 6 are end perspective views showing the stages of assembly of the blanks of FIG. 1 to form the carton according to the present invention.
Figure 3:
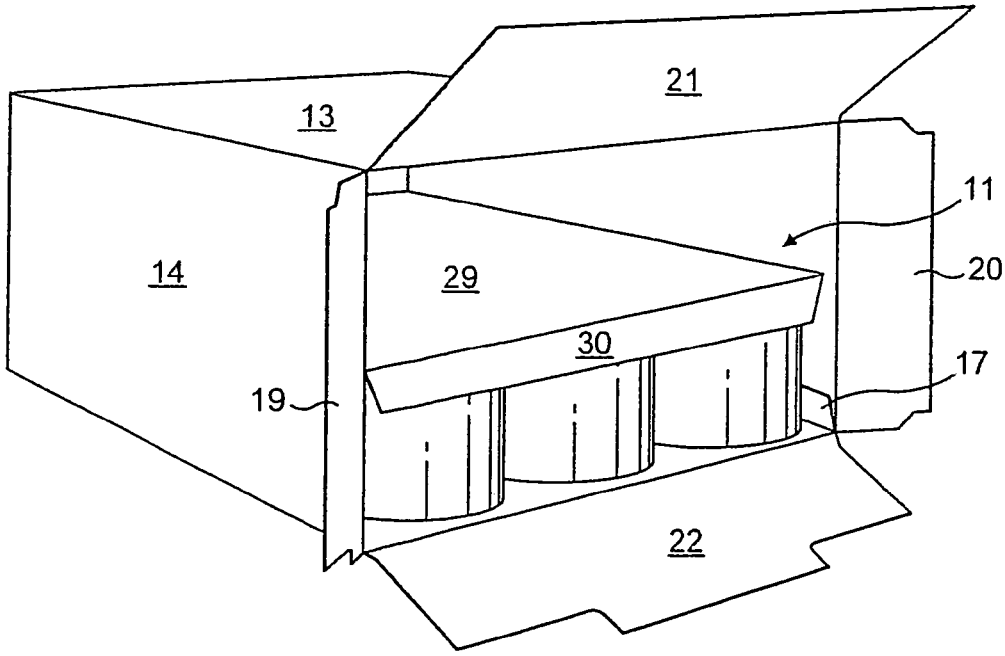
Figure 4:
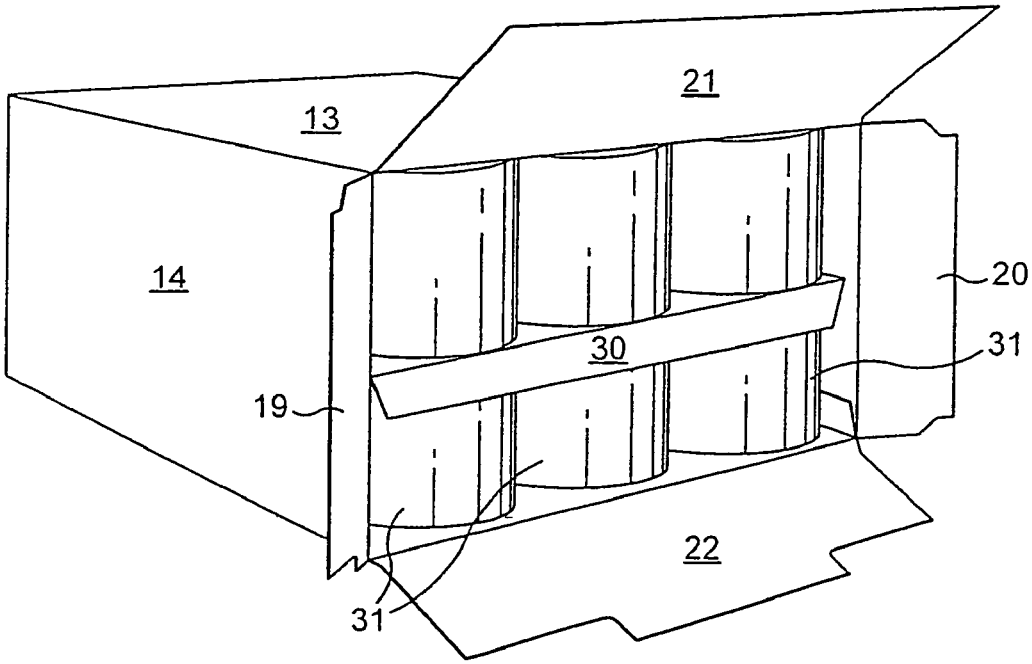
Figure 5:
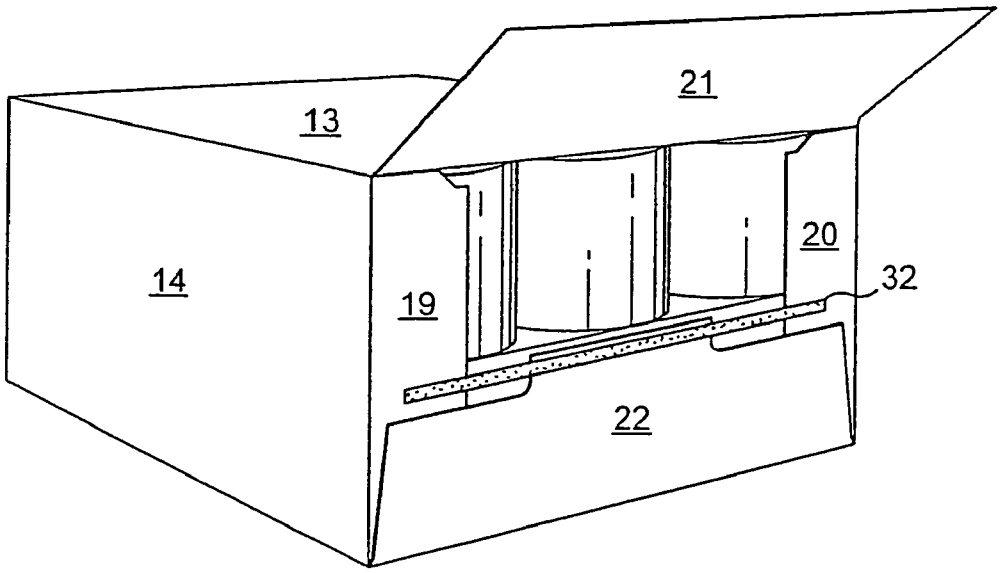

To assemble the carton 12 the adhesive flap 17 of the main blank 10 is secured to the side panel 14 and the main blank 10 is opened up to form an open-ended sleeve. A layer of cans 31 are then inserted into the sleeve so as to have their ends lying on the base panel 16 as shown in FIG. 2. The second blank 11 is then inserted as shown in FIG. 3 so as to lie on top of the layer of cans 31. A second layer of cans 31 is then inserted into the sleeve so as to lie on top of the main panel 29 of the divider pad 11 with the glue panels 30 folded down at both ends of the sleeve so as to lie against the lower layer of cans 31, as shown in FIG. 4. The side end flaps 19, 20 at each end are then folded in and the base end flaps 22 are folded up and at each end a single straight glue line 32 is applied to the side end flaps 19, 20, the glue panel 30 and to the central area 23 of the base end flap 22 as shown in FIG. 5. The top end flap 21 at each end is then folded down into contact with the glue line 32 so as to be adhesively secured to the glue panel 30, the base end flap 22 and the side end flaps 19, 20.

Figure 8:
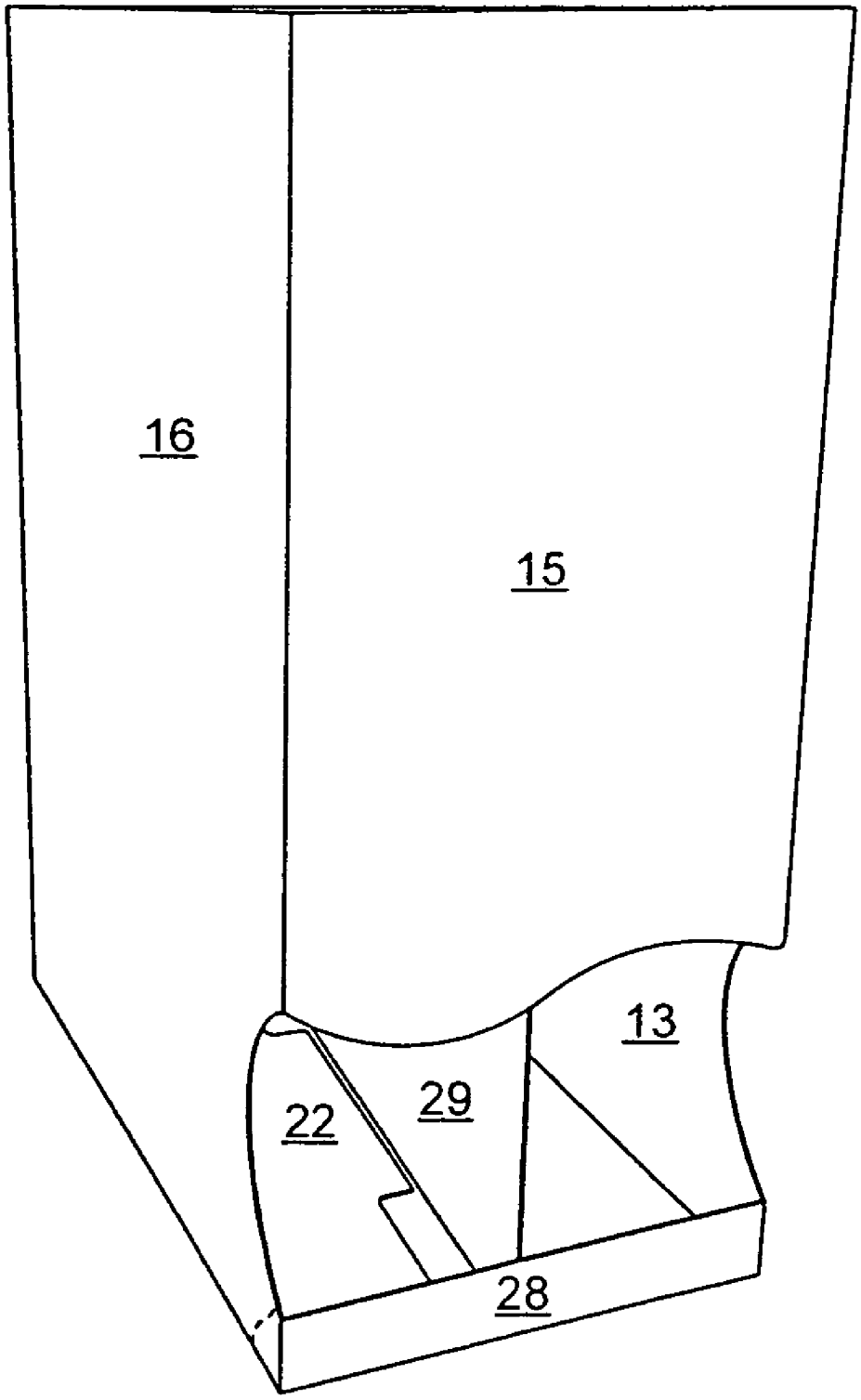
FIG. 8 is another side perspective view of the assembled carton standing on one side with a removable portion removed to define a roll-out aperture.

The carton 12 is thus fully assembled as shown in FIG. 6 and all panels can display product and promotion information, advertising, logos, competition details etc. In store, the carton 12 can be placed on a shelf on its end adjacent the removable portion 33 which faces toward the consumer. This is shown in FIG. 7. Side panel 15 is, therefore, particularly suited to displaying advertising logos and other information. The removable portion 33 is then removed so as to enable consumers to remove the cans 31 through the resulting roll-out dispensing aperture as shown in FIG. 8. The stop wall 28 prevents the cans 31 from rolling out of the carton 12.

The carton 12 can occupy a relatively small horizontal space on the shelf compared to conventional shrink-wrapped trays for cans and can provide significant advertising/information areas, for example on the side panel 15.

Figure 9:
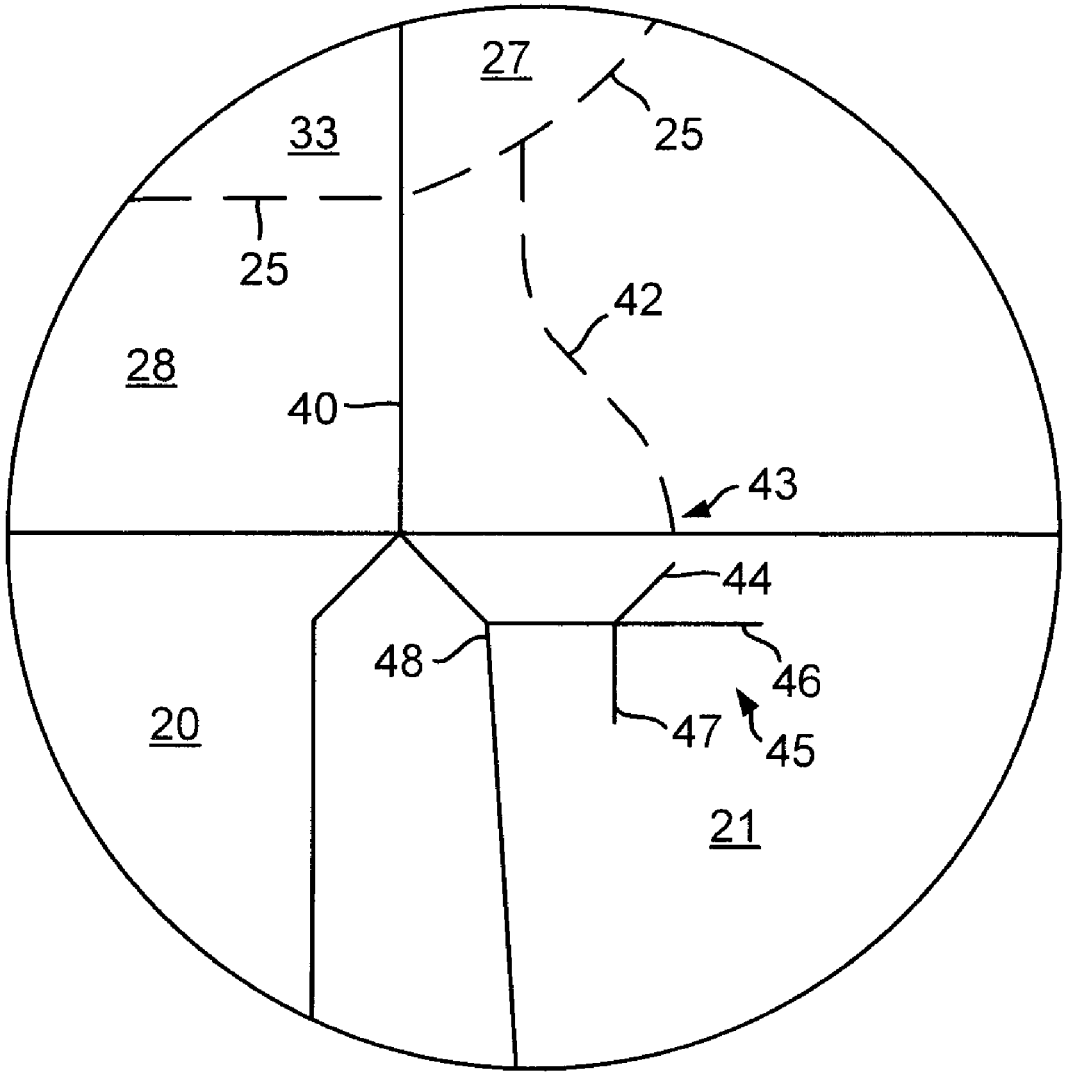
FIG. 9 is an enlarged view of a detail of a preferred blank for producing a carton according to the present invention.

In FIG. 9 there is shown a detail which has not been discussed above. Looking at the blank detail in FIG. 9 the folds between the side panel 15 and the top panel 13 and the base panel 16 are indicated by numerals 40 and 41 respectively. The primary line of weakening 25 adjacent the stop wall 28 crosses the folds 40 and 41.

A secondary line of weakening 42 extends from the primary line of weakening 25 which defines the extensions 26 and 27 of the removable portion 33 such that there is one secondary line of weakening 42 in the top panel 13 and one in the base panel 16. Each secondary line of weakening 42 is serpentine in form and extends from a point located near the lowermost point of the removable portion when in use towards the end edge of the top/base panel where the top end flap 21/bottom end flap 22 are hingedly connected. The end 43 of the secondary line of weakening at the end fold is further from the fold 40/41 than the end adjoining the primary line of weakening 25.

This enables the lower front corner areas and the stop wall 28, on breaking of the secondary lines of weakening 42, to pivot slightly forwards generally about a line joining the ends 43. This facilitates easier removal of the cans but returns to its original shape after a can has been removed.

A further preferred feature shown in FIG. 9 is that in the end flaps 21, 22 a short angled cut 44 extends towards the fold 40/41 from just short of the area of end 43 of each secondary line of weakening 42. At the end of each angled cut 44 is a T-shaped cut 45, the cross bar 46 of which is parallel to the end fold and the upright 47 of which is parallel to the folds 40/41. Also, the cross bars 46 of the cuts 45 extend to the free edges 48 of the top end flaps 21/bottom end flap 22 respectively. This feature assists movement of the lower corner areas in use and assists in the distribution of stresses during this movement.

It will be appreciated that other products could be packaged in this way, not just cylindrical cans, although cylindrical articles are particularly well suited to the carton. In addition the carton could be modified to accommodate more than two layers of cans, each layer separated by a divider pad which is secured at least to the end panel arrangement adjacent the roll-out aperture and preferably to both end panel arrangements. Other methods of assembly of the finished carton could also be readily envisaged.

What is claimed is:

1. A paperboard carton for articles arranged in at least two layers, the carton having a top panel, a base panel, a pair of oppositely disposed side panels, a pair of oppositely disposed end panel arrangements and a divider pad provided between the adjacent layers of articles and being secured relative to the end panel arrangement at one end, one of the side panels having a removable portion adjacent said one end so as to define by means of primary lines of weakness a roll-out aperture for article removal when the carton is standing on said one end panel arrangement, the primary lines of weakness defining a closed curvilinear shape circumscribed by a pair of opposed remaining portions of the respective side panel, and respective remaining portions of the top panel and base panel, which removable portion has extensions in the top and base panels that are formed by respective portions of the primary lines of weakness which extend into the top and base panels, wherein a secondary line of weakness extends from each of the respective portions of the primary lines of weakness that forms the extensions to an adjacent end edge of the top and base panels respectively.

2. A carton as claimed in claim 1 wherein each end panel arrangement incorporates a pair of oppositely disposed main end flaps hingedly connected to the top and base panels respectively.

3. A carton as claimed in claim 2 wherein the start of each secondary line of weakness adjacent the extension is closer to a respective side edge of the top and base panels than to the end of the respective secondary line of weakness at the end edge.

4. A carton as claimed in claim 3 wherein each secondary line of weakness is serpentine in shape.

5. A carton as claimed in claim 3 wherein each secondary line of weakness continues into the adjacent main end flap.

6. A carton as claimed in claim 5 wherein the continuation of each secondary line of weakness is angled back towards the side edge and terminates at a transverse T-shaped cut.

7. A carton as claimed in claim 6 wherein the upright of the T-shaped cut is generally parallel to the side edge and the cross-bar of the T-shaped cut is generally parallel to the end edge.

8. A carton as claimed in claim 1 wherein each secondary line of weakness comprises a cut having a number of breakable retaining bridges.

9. A carton as claimed in claim 1 wherein the divider pad is secured relative to the other end panel arrangement.

10. A carton as claimed in claim 2 wherein the divider pad has a fold down gluing panel at the end.

11. A carton as claimed in claim 10 wherein the top panel main end flap is folded down last and is adhesively secured the fold down gluing panel.

12. A carton as claimed in claim 11 wherein the side panels have respective side panel end flaps hingedly connected to the side panels and a single straight glue line effects adhesive attachment of the top panel main end flap to the base panel main end flap, the side panel end flaps, and the fold down gluing panel.

13. A carton as claimed in claim 12 wherein the base panel main end flap has a central projecting area such that the straight glue line is provided in turn on one of the side panel end flaps, the gluing panel, the central projecting area of the base panel main end flap, the fold down gluing panel and one of the side panel end flaps.

14. A carton as claimed in claim 1 wherein the carton is substantially parallelepipedal.

15. The carton of claim 1 wherein the removable portion comprises a portion of one of the side panels and the extensions in the top and base panel, and a portion of the one side panel is located adjacent the removable portion and forms a stop wall below the removable portion to restrain articles from being dispensed through the roll-out aperture.

16. The carton of claim 15 wherein respective ends of the secondary line of weakness extending from each of the extensions form a pivot line for pivoting the stop wall to expand the roll-out aperture.

17. The carton of claim 1 wherein the top panel and the base panel are each respectively foldably connected to one of the side panels at respective fold lines, each of the respective portions of the primary lines of weakness being curved and respectively extending between points of intersection with one of the respective fold lines to define a respective one of the extensions in the top and base panels.

18. A blank for forming a paperboard carton, the blank comprising:

a plurality of panels, the plurality of panels comprising a top panel, a base panel, a first side panel, and a second side panel;

a removable portion at least partially defined by primary lines of weakness for at least partially separating the removable portion from the blank, the removable portion comprising at least a portion of one of the side panels, a top panel extension extending into at least a portion of the top panel formed by at least a portion of the primary lines of weakness which extends into the top panel, and a base panel extension extending into at least a portion of the base panel formed by at least a portion of the primary lines of weakness which extends into the base panel, wherein the removable portion of the side panel defines first and second remaining portions of the side panel, the first and second remaining portions being separated from one another by the removable portion of the side panel, such that the first and second remaining portions are in a non-contacting relationship at opposite ends of the respective side panel; and a first secondary line of weakness extending from the at least a portion of the primary lines of weakness that forms the top panel extension to an edge of the top panel and a second secondary line of weakness extending from the at least a portion of the primary lines of weakness that forms the base panel extension to an edge of the base panel.

19. A blank as claimed in claim 18 further comprising end flaps, wherein the end flaps comprise top end flaps respectively hingedly connected to opposite ends of the top panel, side end flaps respectively hingedly connected to respective opposite ends of the first and second side panels, and base end flaps respectively hingedly connected to opposite ends of the base panel.

20. A blank as claimed in claim 19 wherein one of the side panels has a side edge respectively corresponding with a fold line foldably connecting the side panel with the base panel and a side edge respectively corresponding with a fold line connecting the side panel with the top panel.

21. A blank as claimed in claim 20 wherein the top panel and base panel have end edges respectively corresponding with fold lines foldably connecting one of the top panel and the base panel with a corresponding one of a top end flap and a base end flap, the start of each secondary line of weakness adjacent each extension is closer to a respective side edge of the side panel than the end of the line of weakness at a respective end edge.

22. A blank as claimed in claim 21 wherein each secondary line of weakness continues into one of a respective top end flap and a base end flap.

23. A blank as claimed in claim 22 wherein each secondary line of weakness in the respective top and base end flap angles back towards a respective side edge and terminates at a transverse T-shaped cut.

24. A blank as claimed in claim 23 wherein the T-shaped cut comprises an upright portion generally parallel to a respective side edge and a cross-bar portion generally parallel to a respective end edge.

25. A blank as claimed in claim 18 wherein each secondary line of weakness is serpentine in shape.

26. A blank as claimed in claim 18 wherein each secondary line of weakness comprises a cut having a number of breakable retaining bridges.

27. A carton as claimed in claim 19 wherein each base end flap has a central projecting area which projects beyond adjacent free edges of the base end flap.

28. A paperboard carton for articles arranged in at least two layers, the carton comprising:

a top panel, a base panel, a pair of oppositely disposed side panels, a pair of oppositely disposed end panel arrangements, each end panel arrangement comprises a pair of oppositely disposed main end flaps hingedly connected to the top and base panels respectively, and a divider pad provided between the adjacent layers of articles and being secured relative to the end panel arrangement at one end, one of the side panels having a removable portion adjacent said one end so as to define by means of primary lines of weakness a roll-out aperture for article removal when the carton is standing on said one end panel arrangement, the removable portion has extensions which extend into the top and base panels, wherein a secondary line of weakness extends from each of the extensions through an adjacent end edge of the top and base panels respectively and into an adjacent main end flap.

29. A paperboard carton for articles arranged in at least two layers, the carton having a top panel, a base panel, a pair of oppositely disposed side panels, a pair of oppositely disposed end panel arrangements and a divider pad provided between the adjacent layers of articles and being secured relative to the end panel arrangement at one end, one of the side panels having a removable portion adjacent said one end so as to define by means of primary lines of weakness a roll-out aperture for article removal when the carton is standing on said one end panel arrangement, which removable portion has extensions in the top and base panels that are formed by respective portions of the primary lines of weakness which extend into the top and base panels, wherein each end panel arrangement incorporates a pair of oppositely disposed main end flaps hingedly connected to the top and base panels respectively, a secondary line of weakness extends from each of the respective portions of the primary lines of weakness that forms the extensions to an adjacent end edge of the top and base panels respectively, and further extends into the adjacent main end flap, and each secondary line of weakness is serpentine in shape, with the start of each secondary line of weakness adjacent the extension being closer to a respective side edge of the top and base panels than the end of the line of weakness at the end edge.

30. A carton as claimed in claim 29 wherein the continuation of each secondary line of weakness is angled back towards the side edge and terminates at a transverse T-shaped cut.

31. A carton as claimed in claim 30 wherein the upright of the T-shaped cut is generally parallel to the side edge and the cross-bar of the T-shaped cut is generally parallel to the end edge.

32. A blank for forming a paperboard carton, comprising:

a plurality of panels including a top panel, a base panel, a first side panel and a second side panel, one of the first and second side panels having a side edge respectively corresponding with a fold line foldably connecting the side panel with the base panel and a side edge respectively corresponding with a fold line connecting the side panel with the top panel, top end flaps respectively hingedly connected to opposite ends of the top panel, side end flaps respectively hingedly connected to respective opposite ends of the first and second side panels, and base end flaps respectively hingedly connected to opposite ends of the base panel;

a removable portion at least partially defined by primary lines of weakness for at least partially separating the removable portion from the blank, the removable portion comprising at least a portion of one of the side panels, a top panel extension extending into at least a portion of the top panel formed by at least a portion of the primary lines of weakness which extends into the top panel, and a base panel extension extending into at least a portion of the base panel formed by at least a portion of the primary lines of weakness which extends into the base panel; and a first secondary line of weakness extending from the at least a portion of the primary lines of weakness that forms the top panel extension to an edge of the top panel and a second secondary line of weakness extending from the at least a portion of the primary lines of weakness that forms the base panel extension to an edge of the base panel, wherein the top panel and base panel have end edges respectively corresponding with fold lines foldably connecting one of the top panel and the base panel with the corresponding top end flap or base end flap, each secondary line of weakness continuing into the respective top end flap or base end flap, the start of each secondary line of weakness adjacent each extension being closer to a respective side edge of the side panel than the end of the line of weakness at a respective end edge.

33. A blank as claimed in claim 32 wherein each secondary line of weakness in the respective top and base end flap angles back towards a respective side edge and terminates at a transverse T-shaped cut.

34. A blank as claimed in claim 33 wherein the T-shaped cut comprises an upright portion generally parallel to a respective side edge and a cross-bar portion generally parallel to a respective end edge.

35. A paperboard carton for articles arranged in at least two layers, the carton having a top panel, a base panel, a pair of oppositely disposed side panels, a pair of oppositely disposed end panel arrangements and a divider pad provided between the adjacent layers of articles and being secured relative to the end panel arrangement at one end, one of the side panels having a removable portion adjacent said one end so as to define by means of primary lines of weakness a roll-out aperture for article removal when the carton is standing on said one end panel arrangement, which removable portion has extensions in the top and base panels that are formed by respective portions of the primary lines of weakness which extend into the top and base panels, wherein the removable portion comprises a portion of one of the side panels and the extensions in the top and base panel, the portion of the one side panel being located adjacent the removable portion and forming a stop wall below the removable portion to restrain articles from being dispensed through the roll-out aperture, and wherein a secondary line of weakness extends from each of the respective portions of the primary lines of weakness that forms the extensions to an adjacent end edge of the top and base panels respectively.

36. The carton of claim 35 wherein respective ends of the secondary line of weakness extending from each of the extensions form a pivot line for pivoting the stop wall to expand the roll-out aperture.

37. A paperboard carton for articles arranged in at least two layers, the carton having a top panel, a base panel, a pair of oppositely disposed side panels, a pair of oppositely disposed end panel arrangements and a divider pad provided between the adjacent layers of articles and being secured relative to the end panel arrangement at one end, one of the side panels having a removable portion adjacent said one end so as to define by means of primary lines of weakness a roll-out aperture for article removal when the carton is standing on said one end panel arrangement, which removable portion has extensions in the top and base panels that are formed by respective portions of the primary lines of weakness which extend into the top and base panels, wherein the top panel and the base panel are each respectively foldably connected to one of the side panels at respective fold lines, each of the respective portions of the primary lines of weakness being curved and respectively extending between points of intersection with one of the respective fold lines to define a respective one of the extensions in the top and base panels, and wherein a secondary line of weakness extends from each of the respective portions of the primary lines of weakness that forms the extensions to an adjacent end edge of the top and base panels respectively.

38. A paperboard carton, comprising:

a plurality of adjoined panels that define an interior space, the plurality of adjoined panels including a side panel including a first side edge and a second side edge, a base panel joined to the side panel along the first side edge of the side panel, a top panel joined to the side panel along the second side edge of the side panel, wherein the side panel, base panel, and top panel each include a respective end edge at an end of the carton;

a removable portion defined by a primary line of weakness in the side panel, base panel, and top panel, the primary line of weakness including an endmost portion extending substantially across the side panel, the endmost portion being substantially parallel to, but distal from, the end edge of the side panel;

a first secondary line of weakness extending substantially from the primary line of weakness in the base panel to the end edge of the base panel, the first secondary line of weakness being more proximate to the first side edge of the side panel at the primary line of weakness in the base panel than at the end edge of the base panel; and a second secondary line of weakness extending substantially from the primary line of weakness in the top panel to the end edge of the top panel, the second secondary line of weakness being more proximate to the second side edge of the side panel at the primary line of weakness in the top panel than at the end edge of the top panel.

39. The carton of claim 38, wherein the interior space is adapted to receive a plurality of articles arranged in at least two layers, and the carton further comprises a divider pad including a main panel adapted to be positioned between the two layers of articles such that the main panel is substantially parallel to at least one of the base panel and the top panel.

40. A blank for forming a carton, comprising:

a plurality of foldably joined panels including a side panel, a base panel joined the side panel along a first fold line extending in a first direction, and a top panel joined to the side panel along a second fold line extending in the first direction, such that the side panel is disposed between the base panel and top panel, wherein the base panel, side panel, and top panel each include an end edge extending in a second direction substantially perpendicular to the first direction;

a primary line of weakness having a closed curvilinear shape, the primary line of weakness defining a removable portion of the side panel, top panel, and base panel, wherein a portion of the primary line of weakness in the side panel is substantially parallel to, but distal from, the end edge of the side panel;

a secondary line of weakness in the base panel, the secondary line of weakness in the base panel having a first endpoint substantially along the primary line of weakness in the base panel, and a second endpoint substantially along the end edge of the base panel, wherein a distance between the first endpoint and the first fold line is less than a distance between the second endpoint and the first fold line; and a secondary line of weakness in the top panel, the secondary line of weakness in the top panel having a first endpoint substantially along the primary line of weakness in the top panel, and a second endpoint substantially along the end edge of the base panel, wherein a distance between the first endpoint and the second fold line is less than a distance between the second endpoint and the second fold line.

41. The blank of claim 40, wherein the first secondary line of weakness and the second secondary line of weakness are serpentine in shape.

42. The blank of claim 40, wherein the plurality of foldably joined panels further includes a base end flap foldably joined to the end edge of the base panel, and a top end flap foldably joined to the end edge of the top panel.

43. The blank of claim 42, wherein a continuation of the first secondary line of weakness extends into the base end flap, and a continuation of the second secondary line of weakness extends into the top end flap.

44. The blank of claim 43, wherein the base end flap includes an end edge distal from and substantially parallel to the end edge of the base panel, and a side edge extending between the end edge of the base end flap and the end edge of the base panel, and the top end flap includes an end edge distal from and substantially parallel to the end edge of the top panel, and a side edge extending between the end edge of the top end flap and the end edge of the top panel.

45. The blank of claim 44, wherein the continuation of the first secondary line of weakness includes a first portion extending obliquely towards the side edge of the base end flap, a second portion extending from an endpoint of the first portion towards the end edge of the base end flap, and a third portion substantially parallel to the end edge of the base panel, the third portion intersecting the endpoint of the first portion and extending substantially to the side edge of the base end flap, and the continuation of the second secondary line of weakness includes a first portion extending obliquely towards the side edge of the top end flap, a second portion extending from an endpoint of the first portion towards the end edge of the top end flap, and a third portion substantially parallel to the end edge of the top panel, the third portion intersecting the endpoint of the first portion and extending substantially to the side edge of the top end flap.

46. The blank of claim 40, wherein the side panel is a first side panel, and the plurality of foldably joined panels further includes a second side panel joined to the top panel along a third fold line extending in the first direction, such that the top panel is disposed between the first side panel and the second side panel.

* * * * *

UNITED STATES PATENT AND TRADEMARK OFFICE

CERTIFICATE OF CORRECTION

PATENT NO. : 7,658,317 B2
APPLICATION NO. : 11/431091
DATED : February 9, 2010
INVENTOR(S) : Zoe Claire Wilkins It is certified that error appears in the above-identified patent and that said Letters Patent is hereby corrected as shown below:

Title page

After the section entitled "Related U.S. Application Data", kindly insert the following:

Item -- (30) Foreign Application Priority Data

November 13, 2003 (GB) .....0326435 --.

Signed and Sealed this

First Day of June, 2010

David J. Kappos

David J. Kappos
*Director of the United States Patent and Trademark Office*